US005957668A

United States Patent [19]

Moody

[11] Patent Number: 5,957,668

[45] Date of Patent: Sep. 28, 1999

[54] BRAKE ACTUATION MEANS FOR A ROTARY PUMP SYSTEM

[75] Inventor: Paul E. Moody, Barrington, R.I.

[73] Assignee: The United States of America as represented by the Secretary of the Navy, Washington, D.C.

[21] Appl. No.: 08/605,290

[22] Filed: Jan. 17, 1996

[51] Int. Cl.[6] ..... F04B 17/00

[52] U.S. Cl. ..... 417/326; 417/15; 417/42; 417/405; 417/409

[58] Field of Search ..... 417/15, 42, 214, 417/319, 326, 405, 406, 407, 409

[56] References Cited

U.S. PATENT DOCUMENTS

| | | | |
|---|---|---|---|
| 2,879,716 | 3/1959 | Meredew et al. | 417/405 |
| 3,044,262 | 7/1962 | Chadwick et al. | 417/409 |
| 3,375,997 | 4/1968 | Gist, Jr. | 224/17.11 |
| 3,565,286 | 2/1971 | Latham, Jr. | 417/426 |
| 5,064,351 | 11/1991 | Hamey et al. | 417/222 |
| 5,358,036 | 10/1994 | Mills | 417/214 |

FOREIGN PATENT DOCUMENTS

| | | | |
|---|---|---|---|
| 1-285692 | 11/1989 | Japan | 417/405 |
| 3-47490 | 2/1991 | Japan | 417/42 |

*Primary Examiner*—Timothy Thorpe
*Assistant Examiner*—Cheryl J. Tyler
*Attorney, Agent, or Firm*—Michael J. McGowan; Prithvi C. Lall; James M. Kasischke

[57] ABSTRACT

A rotary pump system includes a rotary pump, a turbine for driving the pump, and a coupling interconnecting a shaft of the turbine and a shaft of the pump. A speed monitoring system determines rotational speed of the pump shaft, is programmed with selected speeds for the pump during operation, and is adapted to send a signal responsive to a difference between the determined speed and the programmed speed. A brake is engageable with the coupling, and a brake valve is adapted to receive the signal and, in response thereto, to operate the brake to conform the speed of the pump to the programmed speed.

12 Claims, 3 Drawing Sheets

BRAKE ACTUATION MEANS FOR A ROTARY PUMP SYSTEM

STATEMENT OF GOVERNMENT INTEREST

The invention described herein may be manufactured and used by or for the Government of the United States of America for governmental purposes without the payment of royalties thereon or therefor.

BACKGROUND OF THE INVENTION (1) Field of the Invention

The invention relates to a rotary pump system wherein a rotary pump is driven by a drive means, and, more particularly, is directed to a rotary pump ejection system for firing of projectiles from submarines.

(2) Description of the Prior Art

Submarine rotary pump ejection systems are well known and have been used onboard a large number of submarines of the U.S. Navy. In FIG. 1, there is shown a prior art rotary pump system, which includes a rotary pump 10 having an inlet 12 in communication with a water supply, typically the ocean environment of a submerged submarine. An annularly shaped outlet 14 leads to a holding tank (not shown) from whence the water is admitted to the breech portion of a launch tube, such as a torpedo tube, to force a projectile, such as a torpedo or missile, out of the tube.

Connected to the rotary pump 10, by way of a coupling 16, is a turbine 18 which serves as a drive means for the pump 10. The turbine is driven by air under pressure, which is admitted to the turbine by an air inlet valve 20 which is in communication with a source 22 of high pressure air, typically from the vessel's air head maintained at about 4,500 lbs/in$^2$.

In operation, the air inlet valve 20, which constitutes a "firing valve" is opened to admit high pressure air to the turbine. Stages of turbine blades in the turbine are caused to rotate a turbine shaft 24 on which the turbine blade stages are mounted. At the downstream end 26 of the turbine 18 there is an air outlet 28 with a muffler 30 disposed therein. A speed sensor 32 is mounted adjacent the turbine shaft 24 and is adapted to determine the speed of the turbine shaft 24, which equals the speed of a rotary pump shaft 34, and communicates such determined speed to a controller 36. The controller 36 is programmed with selected speeds desired of the pump 10 throughout a launch cycle. The controller 36 compares the determined speed received from the speed sensor 32 with the programmed speed at that point in the launch cycle and identifies any difference. The controller 36 then signals the air inlet valve 20 to adjust the admittance of air to the turbine 18 to alter the speed of the turbine, to thereby alter the speed of the pump. The speed monitoring system, including the sensor 32 and the controller 36, operates continuously during a launch to move the projectile through the launch tube at appropriate speeds.

The above-described system, which is designed for modern U.S. submarines, has performed well but has shortcomings which must be addressed. The first is operational, in that there is a built-in lag time between speed detection and speed correction, based upon the fact that it takes time to adjust the firing valve to charge the rate at which air is admitted to the turbine, and time for the turbine speed to adjust to the modified supply of air. A second problem is derived from defense budgetary demands. The firing valve, which is a variable valve adapted to receive and respond to electronic signals from the controller, is a very expensive component of the system.

Thus, there exists a need for a better and less expensive rotary pump speed control system.

SUMMARY OF THE INVENTION

An object of the invention is to provide a rotary pump ejection system for firing of projectiles from submarines, the system having facility for controlling the speed at which the rotary pump rotates during a launch operation, such that the velocity of the missile in its launch tube, during a launch operation, is substantially equal to a desired velocity.

A further object of the invention is to provide means for controlling the speed of the rotary pump in a manner which not only accomplishes the desired control of pump speed, but does so at a marked reduction in the cost of such control.

With the above and other objects in view, as will hereinafter appear, a feature of the present invention is the provision of a rotary pump system comprising a rotary pump, a turbine for driving said pump, and a coupling interconnecting a shaft of the turbine and a shaft of the pump. The invention further includes a speed monitoring system for determining rotational speed of the pump, the monitoring system being programmed with selected speeds for the pump during operation, and being adapted to send a signal indicative of a difference between the determined speed and the programmed speed. The invention still further includes a brake for engaging the coupling, and a brake valve adapted to receive the signal from the controller and, in response thereto, to operate the brake to conform the speed of the pump shaft to the programmed speed.

In accordance with a further feature of the invention, there is provided a rotary pump ejection system for launch of projectiles from a submarine, the system comprising a rotary pump for ejecting water for use in a launch tube to effect launch of a projectile therein, an air turbine for driving the rotary pump, and a coupling for connecting a shaft of the turbine to a shaft of the rotary pump. The invention further includes a speed monitoring system for determining rotational speed of the pump, the monitoring system being programmed with selected speeds for the pump during a missile launch, and being adapted to send a signal indicative of a difference between the determined speed and the programmed speed. The invention still further includes a brake for engaging the coupling to slow the rotational speed of the pump, and a brake valve adapted to receive the signals from the speed monitoring system and to progressively engage the brake with the coupling and disengage the brake from the coupling to conform the speed of the pump to the programmed selected speeds.

The above and other features of the invention, including various novel details of construction and combinations of parts, will now be more particularly described with reference to the accompanying drawings and pointed out in the claims. It will be understood that the particular system embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
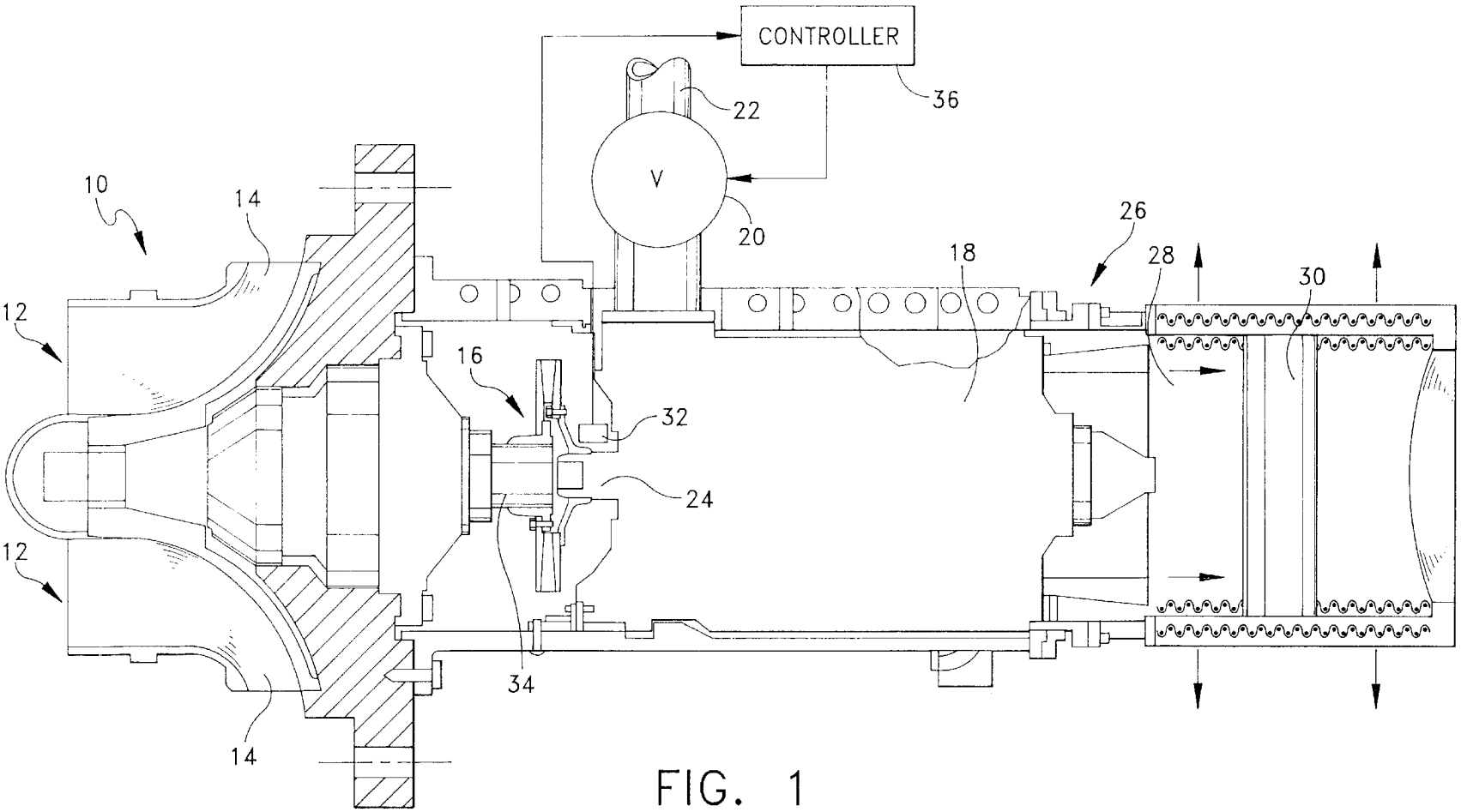
FIG. 1 (PRIOR ART)
FIG. 1 is a diagrammatical illustration of a rotary pump ejection system of the prior art.
Figure 2:
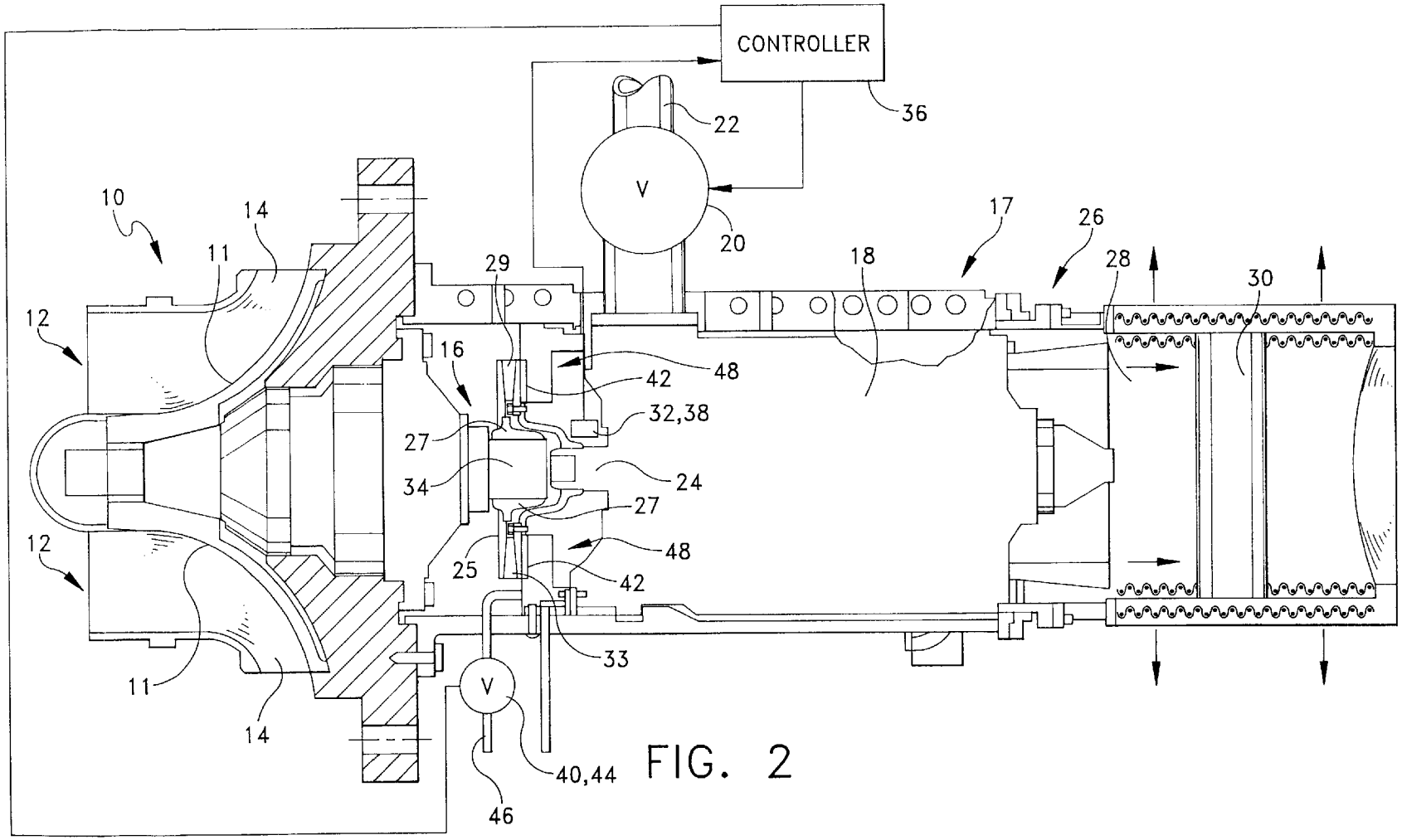
FIG. 2 is a diagrammatical view, similar to FIG. 1, showing one form of rotary pump ejection system illustrative of an embodiment of the invention.

Referring to FIG. 2, it will be seen that the illustrative system includes the rotary pump 10 for ejecting water into a holding tank from whence the water is admitted to a launch tube (not shown) to effect launch of a projectile, such as a torpedo or missile. The rotary pump 10 draws water, typically seawater, in through the entry port 12 and discharges water through the ejection port 14. Impellers 11 of the pump 10 are fixed to the pump shaft 34, which turns with the impellers 11. In operation, the pump impellers 11 are caused to rotate when a firing cycle is initiated, as will be described herein below. Rotation of the impellers 11 draws seawater in through entry port 12 and pushes pressurized water out the ejection port 14, to the aforementioned holding tank from whence the water, under pressure, is led into the breech of a launch tube, to force the projectile out an open end of the tube.

Referring still to FIG. 2, it will be seen that the illustrative system includes a pump drive means 17, typically a turbine 18 driven by high pressure air, which is taken from an air source 22, preferably the submarine's air header (not shown) maintained at about 4,500 p.s.i. The firing valve 20 is disposed between the air source 22 and the turbine 18 and, when opened, admits high pressure air to the turbine 18 to turn the turbine 18. The turbine 18 includes a number of stages mounted on a turbine shaft 24. The turbine 18 at the downstream end 26 thereof, is provided with the air flow outlet 28 having the muffler 30 therein.

Figure 3:
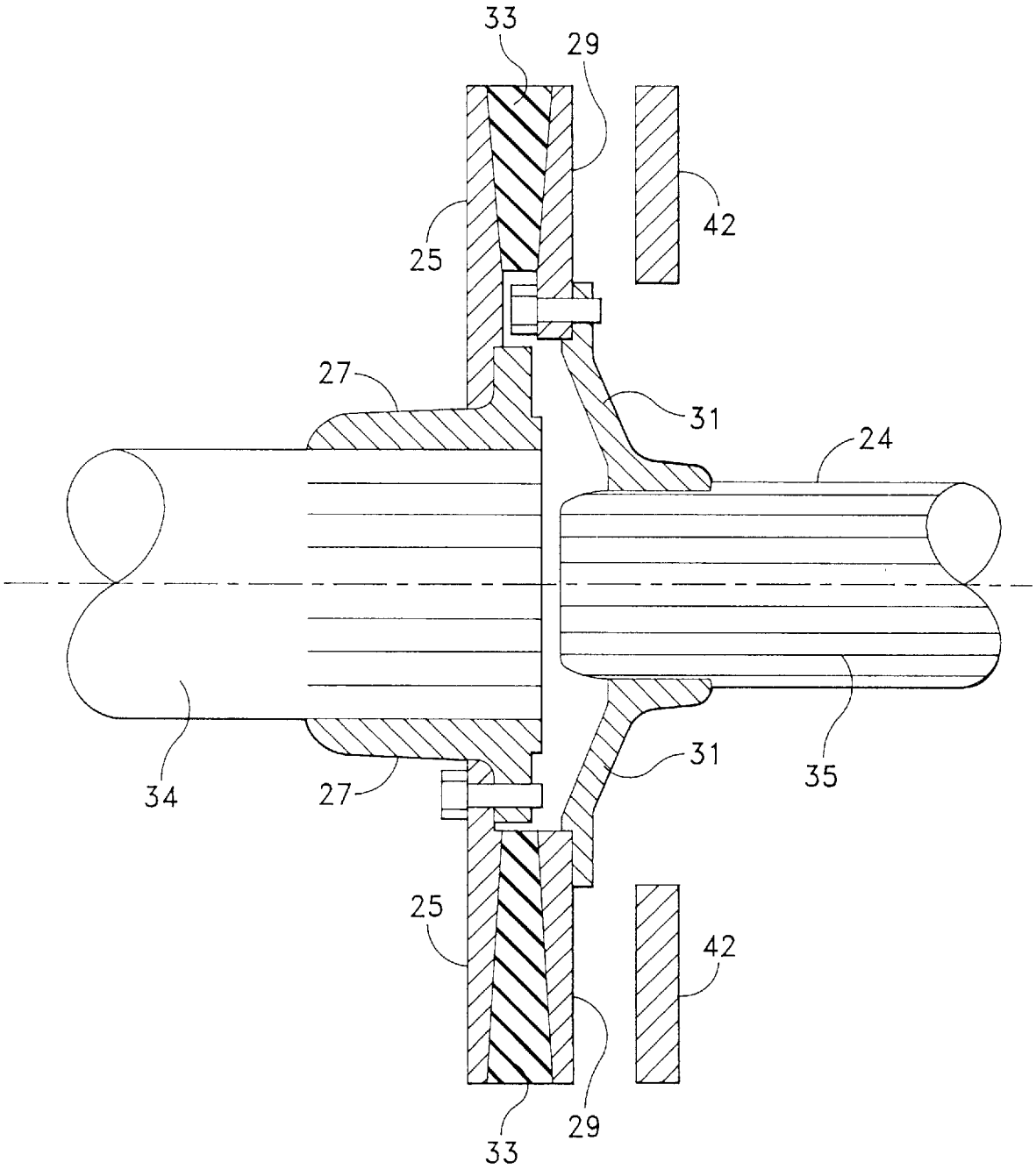
FIG. 3 is an enlarged sectional view of a coupling and brake portion of the system shown in FIG. 2.

Interconnecting the turbine 18 and the pump 10 is the coupling 16 which comprises a pump coupling disc 25 fixed to a pump shaft connector 27 mounted on the shaft 34 of the pump 10. A detail view of the coupling 16 is provided in FIG. 3. The coupling 16 further comprises a turbine coupling disc 29 fixed to a turbine shaft connector 31 mounted on the turbine shaft 24. Fixed to the pump coupling disc 25 and the turbine coupling disc 29, and disposed therebetween is an elastomeric ring 33. Thus, rotation of the turbine 18 is transmitted from the turbine 18 to the pump 10. In operation, when rotation of the pump 10 is desired, to effect launch of a projectile, the firing valve 20 is opened to admit pressurized air to the turbine 18, which turns and which thereby drives the pump 10, to eject the water needed to effect a launch.

In the course of a launch operation, the speed sensor 32 (FIG. 2) disposed adjacent the turbine shaft 24 determines the speed of the turbine shaft 24, and thereby the speed of the pump shaft 34, and thereby the speed of the pump 10. Preferably, the turbine shaft 24 is provided with markings 35 (FIG. 3) and the sensor 32 comprises a photocell 38 (FIG. 2) which is adapted to input the speed of the markings and determine thereby the speed of the turbine shaft 24. The sensor 32 is adapted to send a signal indicative of the determined pump speed to the controller 36. Obviously, speed sensor 32 could be an induced magnetic field proximity device or any other speed sensor.

The controller 36 is programmed with selected desired pump speeds required to obtain desired projectile velocity throughout the launch cycle. The controller 36 is adapted to receive the signal from the speed sensor 32 and compare the speed determined by the sensor 32 with the speed programmed in the controller 36 for that point in time, and note any difference between the determined speed and the programmed speed. Based upon the noted difference, the controller 36 sends a signal to a brake actuator 40 to actuate brake pads 42 of a brake assembly 48 to engage, or release engagement with, the turbine disc 29 to alter the speed of the pump 10.

The brake preferably is a hydraulic disc brake and the brake actuator 40 preferably is a valve 44 disposed in a hydraulic line 46. The brake pads 42 are movable axially to progressively engage the turbine disc 29 and to progressively disengage from the disc 29, according to the operation of the brake valve 44.

Thus, in operation, the speed sensor 32 determines, for example, the rotational speed of pump 10 and communicates that determined speed to the controller 36. The controller 36 compares the determined speed with the programmed speed for that point in time in the launch cycle, and identifies the difference, as for example, a given excess in the speed. Based upon that excess, the controller 36 signals the brake valve 44 to admit hydraulic fluid to the brake 48. Upon admission of hydraulic fluid to the brake 48, the brake pads 42 move into engagement with the turbine disc 29, causing the pump 10 to slow. In short order, the sensor 32 determines the new pump speed which is signalled to the controller 36. The controller 36 compares the new determined speed with the current programmed speed and identifies, for example, equality. Thereupon, the controller 36 signals the brake valve 44 to close down on the supply of hydraulic fluid to the brake assembly 48. The brake valve 44 follows the instruction of the controller 36 and the brake pads 42 are caused to back away from the disc 29. The determination of pump speed by the sensor 32, the comparison of determined speeds and programmed speeds by the controller 36, signals from the controller 36 to the brake valve 44, and consequent operation of the brake 48 is a continuous undertaking throughout the launch cycle. At the end of the launch, the controller 36 orders the firing valve 20 to close.

Thus, the firing valve 20 is essentially an "open or closed" valve of relatively little expense. The brake system comprises known components which are inexpensive compared to the expense of the variable firing valves in the prior art. The system presented herein therefore accomplishes all that the prior art system accomplishes, improves upon control of projectile velocity, and does so at considerably less expense.

It is to be understood that the present invention is by no means limited to the particular construction herein disclosed and/or shown in the drawings, but also comprises any modifications or equivalents within the scope of the claims. For example, while the invention has been described with respect to submarines, it will be appreciated that the launch aspects of the invention find utility in any undersea platform and that the rotary pump brake aspects of the invention find utility in any rotary pump assembly wherein speed control of the rotary pump is critical. Further, while for illustrative purposes launch of missiles and torpedoes has been discussed, it will be apparent that launch of other devices, such as mines and special purpose bodies, is contemplated.

What is claimed is:

1. A rotary pump system comprising:

a rotary pump;

drive means for driving said pump;

a coupling interconnecting said drive means and said pump;

a speed monitoring system having a sensor for determining rotational speed of said pump, and a controller joined to said sensor, said controller comparing said determined speed with a programmed speed at a given time and sending a signal responsive to a difference between said determined speed and said programmed speed;

a brake for slowing said rotational speed of said pump, wherein said coupling comprises a drive means disc extending radially from said shaft of said drive means, a pump disc extending radially from a shaft of said pump, said drive means disc being connected to said pump disc, and said brake comprises pads moveable into engagement with said drive means disc to slow said pump; and brake actuation means adapted to receive said signal and, in response thereto, to operate said brake to conform the speed of said pump to said programmed speed.

2. The rotary pump system in accordance with claim 1 wherein said drive means comprises a turbine.

3. The system in accordance with claim 2 wherein said turbine is driven by pressurized air, and said system further comprising a valve joined to said turbine for admitting the pressurized air to said turbine.

4. The rotary pump system in accordance with claim 1 wherein said sensor comprises a photocell adapted to send a shaft speed signal to said controller indicative of the pump shaft speed determined by said photocell.

5. The rotary pump system in accordance with claim 3 wherein said controller is joined to said valve to send a value control signal to said valve for closing said valve at the end of a cycle of operation.

6. A rotary pump system comprising:

a rotary pump having a pump shaft;

a turbine having a turbine shaft for driving said pump;

a coupling interconnecting said turbine shaft and said pump shaft;

a speed monitoring system having a sensor for determining rotational speed of said pump shaft, and a controller in communication with said sensor, said controller being programmed with selected speeds for said pump shaft during operation, comparing said determined speed with one selected, programmed speed and sending a signal responsive to a difference between said determined speed and said programmed speed;

a brake for engaging said coupling; and a brake valve adapted to receive said signal and, in response thereto, to operate said brake to conform the speed of said pump shaft to said programmed speed;

wherein said coupling comprises a turbine disc extending radially from said shaft of said turbine, a pump disc extending radially from a shaft of said pump, said turbine disc being connected to said pump disc, and said brake comprises pads moveable into engagement with said turbine disc to slow said pump.

7. The rotary pump system in accordance with claim 6 wherein said turbine is air driven and said rotary pump system includes a turbine valve joined to said turbine for admitting air under pressure to said turbine.

8. The rotary pump system in accordance with claim 7 wherein said controller is in communication with said turbine valve to close said valve upon completion of a cycle of said rotary pump operation.

9.The rotary pump system in accordance with claim 6 wherein said turbine shaft is marked and said sensor is a photo cell adapted to determine from movement of said turbine shaft markings the rotational speed of said pump shaft.

10. A rotary pump ejection system for launch of projectiles from a submarine, said system comprising:

a rotary pump having a pump shaft for ejecting water into a launch tube to effect launch of a projectile therein;

an air turbine having a turbine shaft for driving said rotary pump;

a coupling for connecting said turbine shaft to said pump shaft;

a speed monitoring system detecting rotational speed of said pump shaft, said monitoring system being programmed with selected speeds for said pump shaft at selected times during a projectile launch, said monitoring system being adapted to send a signal responsive to a difference between said determined speed and said programmed speed;

a brake capable of engaging said coupling to slow said rotational speed of said pump shaft and thereby said pump;

a brake valve adapted to receive said signal from said speed monitoring system and to progressively engage said brake with said coupling and disengage said brake from said coupling to conform the speed of said pump shaft to said programmed speed, said speed monitoring system comprising a speed sensor detecting said rotational speed of said pump shaft, and a controller for receiving a shaft speed signal from said sensor indicative of said detected pump shaft rotational speed, said controller being programmed with said selected speeds for said pump shaft during a projectile launch, said controller being adapted to compare said detected speed with said programmed speed, and to send a brake valve control signal to said brake valve responsive to a difference between said determined speed and said programmed speed of said pump shaft, said brake valve being adapted to receive said brake valve control signal from said controller; and a firing valve joined to said turbine for admitting air under pressure to said turbine, said controller being in communication with said firing valve to close said firing valve at the conclusion of a launch cycle.

11. The rotary pump ejection system in accordance with claim 10 wherein said coupling includes a turbine disc extending radially from said turbine shaft, and a pump disc extending radially from said pump shaft, said turbine disc being fixed to said pump disc, and said brake includes brake pads movable to progressively engage and disengage said pads and said turbine disc.

12. The rotary pump ejection system in accordance with claim 11 wherein said brake is in communication with said brake valve and operative in response to operation of said brake valve to effect said progressive engagement and disengagement of said pads and said turbine disc.

* * * * *